US006526881B2

(12) United States Patent
Iimura

(10) Patent No.: US 6,526,881 B2
(45) Date of Patent: Mar. 4, 2003

(54) STENCIL PRINTING MACHINE HAVING SHEET CLAMP GUIDE MEMBER FOR GUIDING SHEET TO CLAMP SECTION OF PRESSURE DRUM

(75) Inventor: Naoyuki Iimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/907,616

(22) Filed: Jul. 19, 2001

(65) Prior Publication Data

US 2002/0014168 A1 Feb. 7, 2002

(30) Foreign Application Priority Data

Jul. 27, 2000 (JP) ..... 2000-227768

(51) Int. Cl.[7] ..... B41L 13/04; B41L 21/00
(52) U.S. Cl. ..... 101/118; 101/116; 101/409
(58) Field of Search ..... 101/114, 116, 101/117, 118, 119, 120, 129, 409, 415.1, 484, 232, 246, 477

(56) References Cited

U.S. PATENT DOCUMENTS 6,098,536 A * 8/2000 Ohkawa ..... 101/116
6,101,935 A * 8/2000 Ohkawa ..... 101/116
2001/0047732 A1 * 12/2001 Kakurai ..... 101/118

* cited by examiner

*Primary Examiner*—Leslie J. Evanisko
(74) *Attorney, Agent, or Firm*—Gary M. Nath; Harold L. Novick; Marvin C. Berkowitz

(57) ABSTRACT

In a printing machine, a tip end of a print sheet 22, which is transferred from a paper feed section 5 synchronously with rotation of a printing drum 16 and a pressure drum 17, is clamped by a sheet clamp section 21 at a rotation clamp position upstream of a press portion on which the printing drum 16 and the pressure drum press each other. The print sheet 22 thus clamped is transferred along an outer peripheral surface of the pressure drum 17 and pressed against a stencil sheet on the press portion. Then, printing is done. The printing machine is provided with a sheet clamp guide member 30 guiding the tip end of the print sheet 22, which is transferred from the sheet feed section 5, to a position on which the print sheet 22 is abutted on a sheet abutment face 21*a* of the sheet clamp section 21 located at the rotation clamp position.

10 Claims, 9 Drawing Sheets

STENCIL PRINTING MACHINE HAVING SHEET CLAMP GUIDE MEMBER FOR GUIDING SHEET TO CLAMP SECTION OF PRESSURE DRUM

BACKGROUND OF THE INVENTION

1. Field of the Invention

The present invention relates to a printing machine having a printing drum onto which a stencil sheet is attached and a pressure drum clamping a print sheet. The printing machine transports the print sheet clamped by the pressure drum along the outer peripheral surface of the pressure drum, whereby the print sheet is pressed against the stencil sheet on a press portion on which the printing drum and the pressure drum press each other.

2. Description of the Related Art

A stencil printing machine as one type of printing machines is constituted so that an image on the print sheet is printed via below-described some steps.

(1) A stencil sheet is thermally perforated so as to correspond to image data.

(2) The stencil sheet thus thermally perforated is wound around and attached onto the outer peripheral surface of a printing drum.

(3) A pressure drum having a sheet clamp section is rotated synchronously with the rotation of the printing drum.

(4) The tip end of a print sheet, which is transported from a paper feed section, is clamped at a rotation upstream position of the press portion on which the printing drum and the pressure drum press each other.

(5) The print sheet thus clamped is transferred along the outer peripheral surface of the pressure drum, whereby the print sheet is transferred while the print sheet is pressed against the stencil sheet attached onto the printing drum.

(6) Ink is transferred to the print sheet in the press and transfer step (that is, (5) step).

The stencil printing machine as described above is required for the sheet clamp section of the rotating pressure drum to receive the print sheet from the paper feed section by clamping the tip end of the print sheet transferred from the paper feed section, and to take over the transportation of the print sheet. The constitution of the printing machine proposed herein is shown in FIGS. 1 and 2.

In FIGS. 1 and 2, a printing drum 100 is rotatably provided about a rotation center C1 in an arrow direction. Furthermore, a stencil sheet clamp section (not shown) clamping the tip end of a stencil sheet (not shown) is provided on the outer peripheral surface of this printing drum 100. The outer peripheral wall of the printing drum 100 is of an ink permeable structure to allow ink to be supplied from inside to the outer peripheral wall. A pressure drum 101 is rotatably provided about a rotation center C2 below the printing drum 100 in an arrow direction. A sheet clamp section 103 clamping the tip end of a print sheet 102 is provided in the vicinity of the outer peripheral surface of the pressure drum 101. The outer peripheral surfaces of the printing drum 100 and the pressure drum 101 are opposite each other, and are constituted to be capable of being pressed relatively to each other by pressing means.

A paper feed section 105 includes a primary paper feed roller (not shown) transferring only an uppermost print sheet 102 from print sheets 102 stacked on a paper feed tray (not shown), a pair of secondary paper feed rollers 106 transferring the print sheet conveyed by the primary paper feed roller toward a pressure drum side, and guide members 107 guiding the print sheet 102 transferred by the pair of secondary paper feed rollers 106 toward a predetermined rotation position on the outer peripheral surface of the pressure drum 101.

In the paper feed section 105, the printing drum 100 to which the stencil sheet is attached and the pressure drum 101 rotate synchronously with each other in the arrow direction shown in FIG. 1. As a result, the print sheet 102 is fed from the secondary paper feed rollers 106 so that the tip end of the print sheet 102 is abutted on the sheet clamp section 103 of the pressure drum 101 at timing at which the sheet clamp section 103 is located at the rotation position shown in FIG. 1 (see a two-dot chain line 102 shown in FIG. 1). Then, the sheet clamp section 103 clamps the tip end of the print sheet 102 thus fed. The clamped print sheet 102 is transferred along the outer peripheral surface of the pressure drum 101 synchronously with the rotation of the pressure drum 101. Ink is transferred onto the print sheet 102 on the press portion on which the printing drum 100 and the pressure drum 101 press each other. The sheet clamp section 103 unclamps the print sheet 102 downstream of the press portion in a rotation direction. The print sheet 102 thus unclamped is transferred to a sheet discharge section (not shown). When the sheet clamp section 103 of the pressure drum 101 arrives at the rotation position shown in FIG. 1, the above-described operation is repeated, whereby printing operation is executed in succession.

As indicated by a solid line shown in FIG. 1, however, if the tip end of the print sheet 102 is warped upward because of the curl, the material or the like of the sheet, the tip end of the print sheet 102 may possibly not be abutted on the sheet clamp section 103. Then, as shown in FIG. 2, the print sheet 102 is transferred to the portion between the pressure drum 101 and the printing drum 100 while the tip end of the print sheet 102 is not clamped by the sheet clamp section 103. If so, the print sheet 102 cannot be transferred further and sheet clogging occurs. In addition, even if the sheet clamp section 103 cannot clamp part of the print sheet 102 and the print sheet 102 is transferred to the portion between the pressure drum 101 and the printing drum 100, the tip end of the print sheet 102 may possibly be, for example, flawed, bent or creased.

SUMMARY OF THE INVENTION

The present invention has been made to solve the above-described problems. It is, therefore, an object of the present invention is to provide a printing machine capable of ensuring clamping the tip end of a print sheet by the sheet clamp section of a pressure drum and capable of preventing the flaw or the like of the tip end of the print sheet.

The first aspect of the invention provides a printing machine comprising: a printing drum around which a perforated stencil sheet is wound, and which is provided rotatably about a first axis; a pressure drum having a sheet clamp section for clamping a tip end of a print sheet, and which is provided rotatably about a second axis; and outer peripheral surfaces of the printing drum and the pressure drum, and provided to be freely pressed relatively to each other, the printing drum and the pressure drum opposite to each other on the outer peripheral surfaces, wherein the tip end of the print sheet, which is transferred from a paper feed section synchronously with rotation of both the printing drum and the pressure drum, is clamped by the sheet clamp section at a rotation clamp position upstream of a press position in a rotation direction, the printing drum and the pressure drum press each other on the press portion, the print sheet thus clamped is transferred along the outer peripheral surface of the pressure drum and the print sheet is pressed against the perforated stencil sheet on the press portion, whereby printing is conducted to the print sheet; and wherein the printing machine is provided with a sheet clamp guide member for guiding the tip end of the print sheet, which is transferred from the paper feed section, to a clamp spot of the sheet clamp section located at the rotation clamp position.

According to the first aspect of the invention, even if the tip end side of the print sheet has a curl such as an upstream warp, the tip end of the print sheet, which is transferred from the paper feed section, is guided to the clamp spot of the sheet clamp section by the clamp guide member.

The second aspect of the invention provides a printing machine according to the first aspect of the invention, wherein the sheet clamp section is divided into a plurality of segments in a direction substantially orthogonal to a sheet transfer direction; wherein guide entry spaces are provided between the divided segments of the sheet clamp section adjacent each other, respectively; and wherein the sheet clamp guide member is divided into a plurality of segments in the direction substantially orthogonal to the sheet transfer direction, and the divided segments of the sheet clamp guide member are arranged to enter the guide entry spaces, respectively, at the clamp position of the sheet clamp section.

According to the second aspect of the invention, the sheet clamp guide member guides the print sheet on the plurality of portions arranged in a direction substantially orthogonal to the sheet transfer direction of the print sheet.

The third aspect of the invention provides a printing machine according to the first aspect of the invention, wherein a guide face, opposite to the pressure drum, of the sheet clamp guide member is arranged along the outer peripheral surface of the pressure drum with a predetermined distance from the pressure drum.

According to the third aspect of the invention, the embracing angle of the sheet clamp guide member with respect to the pressure drum is wider and the stable transfer of the print sheet by the pressure drum is ensured.

The fourth aspect of the invention provides a printing machine according to the first aspect of the invention, wherein the paper feed section comprising: guide members, wherein the sheet clamp guide member is arranged on a lowest transfer downstream portion of the paper feed section, and extended from one of the guide members for guiding the print sheet by putting the print sheet between the guide members from both upper and lower directions.

According to the fourth aspect of the invention, the sheet clamp guide member surely takes over the guiding of the print sheet conducted by the guide members of the sheet feed section, or the guide members are arranged to be positioned with respect to the pressure drum, so that the positioning of the sheet clamp guide member relative to the sheet clamp section can be easily conducted.

The fifth aspect of the invention provides a printing machine according to the first aspect of the invention, wherein the sheet clamp guide member is easily bent in a direction opposite to a contact direction when the print sheet contacts with the sheet clamp guide member.

According to the fifth aspect of the invention, if the sheet clamp section clamps the tip end of the print sheet, and the print sheet thus clamped is transferred along the outer peripheral surface of the pressure drum synchronously with the rotation of the pressure drum, the print sheet contacts with the sheet clamp guide member due to the flexibility or the like of the sheet. Then, the sheet clamp guide member is easily bent in an opposite direction to a contact direction.

The sixth aspect of the invention provides a printing machine according to the fourth aspect of the invention, wherein the guide member is easily bent in a direction opposite to a contact direction when the print sheet contacts with the guide member.

According to the sixth aspect of the invention, if the sheet clamp section clamps the tip end of the print sheet, and the print sheet thus clamped is transferred along the outer peripheral surface of the pressure drum synchronously with the rotation of the pressure drum, the print sheet contacts with the guide members due to the flexibility or the like of the sheet. Then, the guide members are easily bent in an opposite direction to a contact direction.

DETAILED DESCRIPTION OF THE PREFERRED EMBODIMENTS

The embodiments of the present invention will be described hereinafter with reference to the drawings.

1. First Embodiment

FIGS. 3 to 8 show the first embodiment of the present invention.

Figure 1:
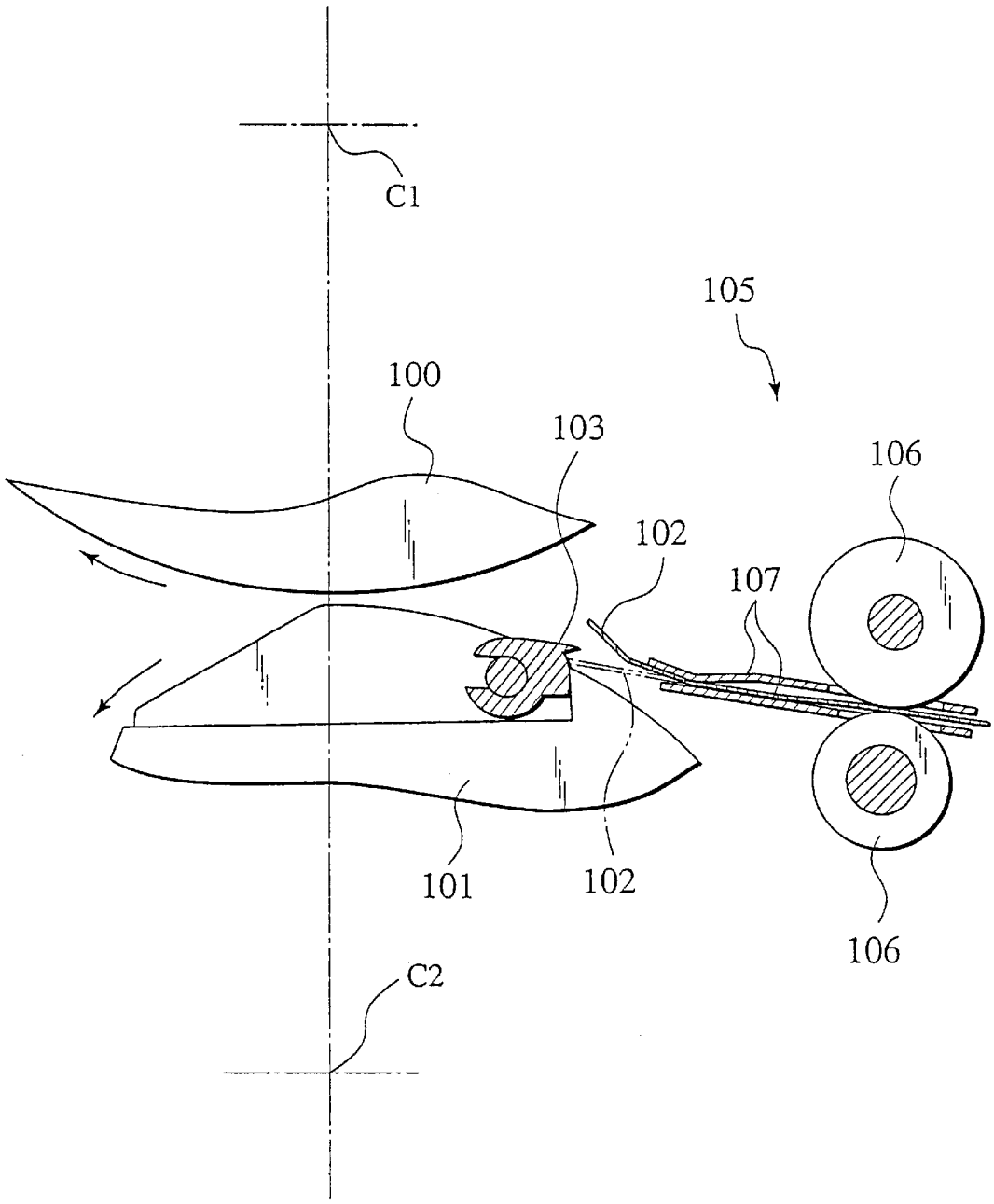
FIG.1 (Prior Art)
FIG. 1 is a side elevational view of a proposed printing machine that shows a state in which the tip end of a print sheet, which is transferred from a paper feed section, warps upward and does not abut on a sheet clamp section.
Figure 2:
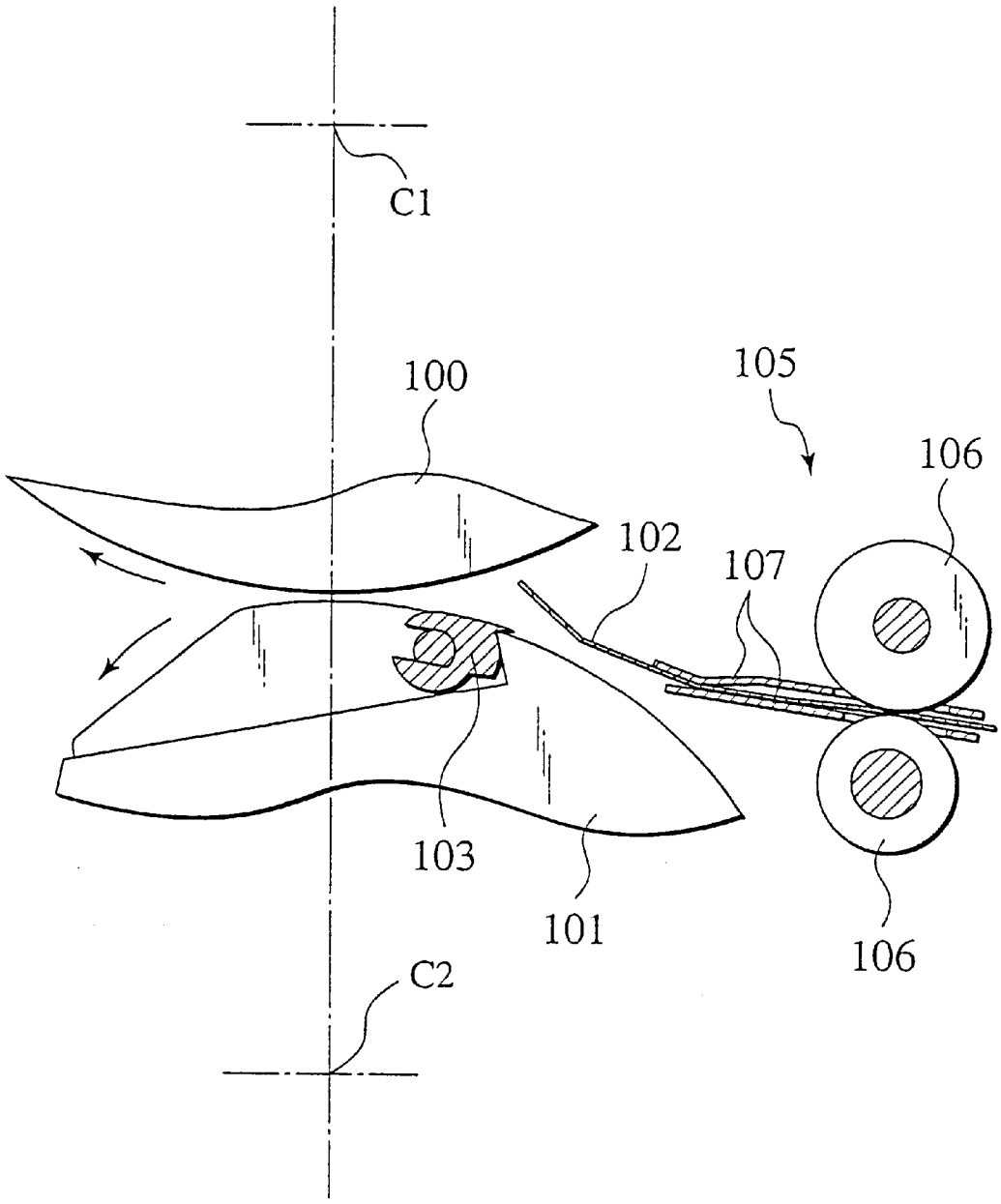
FIG.2 (Prior Art)
FIG. 2 is a side elevational view of the proposed printing machine that shows a state in which the tip end of the print sheet, which is transferred from a paper feed section, warps upward and in which a sheet clamp section cannot clamp the print sheet.
Figure 3:
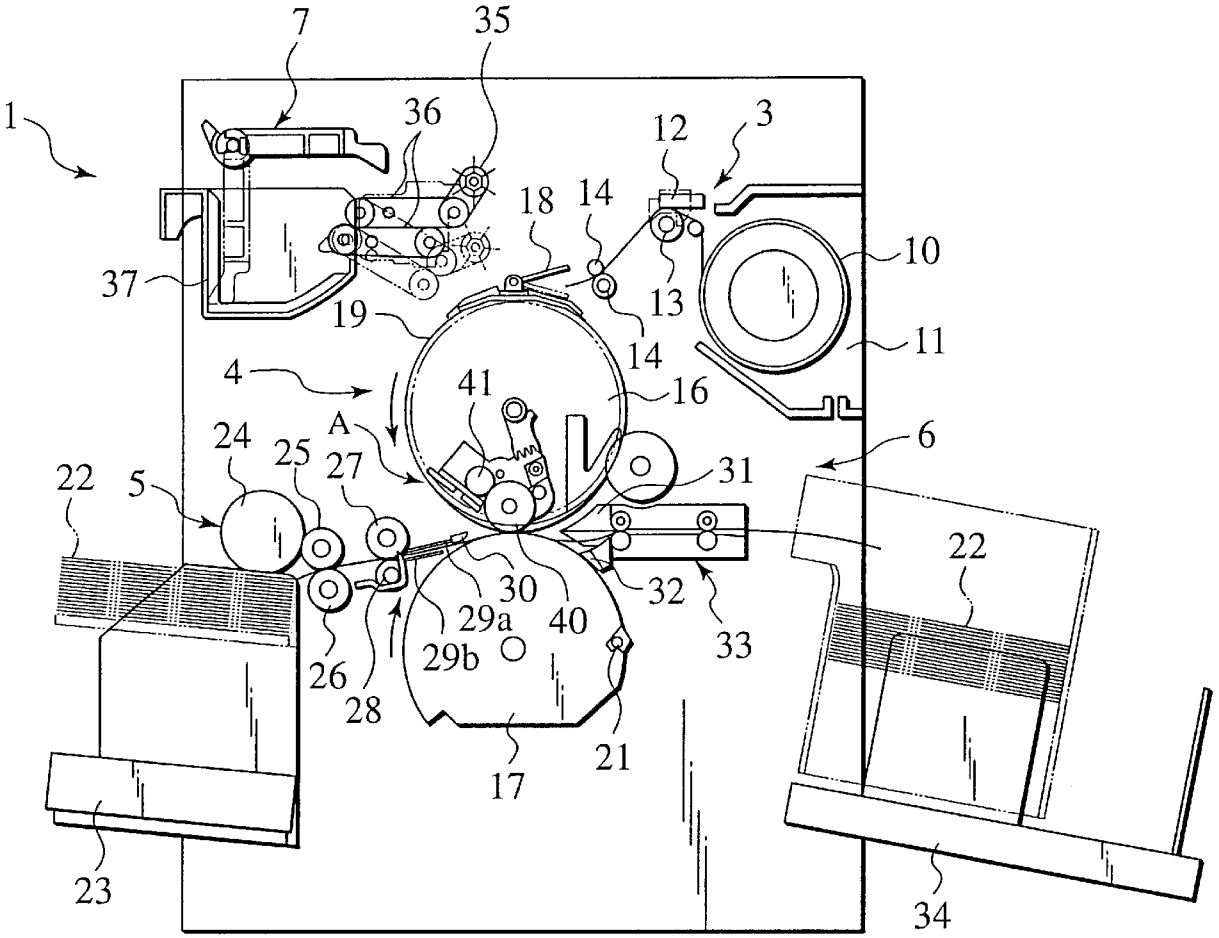
FIG. 3 is a schematic side elevational view of a stencil printing machine in the first embodiment according to the present invention.

(1) Constitution of Stencil Printing Machine:

As shown in FIG. 3, a stencil printing machine 1 mainly includes an original read section (not shown), a stencil making section 3, a printing section 4, a paper feed section 6, a sheet discharge section 6, a stencil disposal section 7.

(a) Original Read Section

The original read section (not shown) reads an original as an electrical signal. Information thus read is constituted to be processible based on a predetermined instruction (enlargement, reduction or the like).

(b) Stencil Making Section

The stencil making section 3 includes an original container section 11 containing a longitudinal stencil sheet 10 which is rolled up, a thermal head 12 arranged downstream in the original containing section 11 in the transfer direction of the stencil sheet 10, a platen roller 13 arranged at a position opposite to the thermal head 12 and rotating in response to the driving force of a pulse motor (not shown), a pair of stencil sheet transport rollers 14 arranged downstream of the platen roller 13 and the thermal head 12 in the transfer direction of the stencil sheet 10 and rotating in response to the driving force of the pulse motor (not shown), a stencil sheet cutter (not shown) arranged between the paired stencil sheet transport rollers 14, the platen roller 13 and the thermal head 12.

(c) Printing Section

The printing section 4 has a printing drum 16 and a pressure drum 17 equal in diameter. The printing drum 16 and the pressure drum 17 are provided rotatably while parts of the respective outer peripheral surfaces are proximate to each other. The printing drum 16 has a pair of cylindrical flanges (not shown) provided to be opposite each other at predetermined intervals. A stencil sheet clamp section 18 is provided on part of the flanges. The stencil sheet clamp section 18 is capable of clamping the tip end of the stencil sheet 10. A flexible screen 19 forming the peripheral wall of the printing drum 16, is put on a portion of the outer peripheral surface of the flanges of the printing drum 16 other than the portion on which the stencil sheet clamp section 18 is provided. This screen 19 is constituted so that ink can permeate the screen 19 when printing pressure is applied in at least a print region.

An inner press roller 40 is rotatably provided in the screen 19 of the printing drum 16. This inner press roller 40 is provided to be movable by pressing means (not shown) between a press position at which the inner press roller 40 presses the inner peripheral surface of the screen 19 and a separation position separated from the inner peripheral surface of the screen 19. At the press position of the inner press roller 40, the screen 19 expands outside and presses the pressure drum 17. A doctor roller 41 is provided proximately to the inner press roller 40. Ink (not shown) is pooled in an outer peripheral space surrounded by the inner press roller 40 and the doctor roller 41. The ink adhering to the outer periphery of the rotating inner press roller 40 passes the space between the inner press roller 40 and the doctor roller 41, whereby the ink is regulated to have a predetermined thickness, the ink having the predetermined thickness adheres onto the inner press roller 40 and the ink is supplied to the inner peripheral surface of the screen 19. A sheet clamp section 21 is provided on a predetermined portion on the outer peripheral surface of the pressure drum 17. This sheet clamp section 21 is capable of clamping the tip end of a print sheet 22 serving as a print medium. The detailed constitution of the sheet clamp section 21 will be described later.

(d) Paper Feed Section

The paper feed section 5 includes a paper feed tray 23 on which print sheets 22 serving as print mediums are stacked, a scraper roller 24 serving as a primary paper feed roller and press-contacted with the uppermost print sheet 22 on the paper feed tray 23, a pickup roller 25 and a stripper roller 26 serving as primary paper feed rollers, arranged downstream of the scraper roller 24 and located almost proximately to each other, a guide roller 27 and a timing roller 28 serving as secondary paper feed rollers, arranged downstream of the pickup roller 25 and the stripper roller 26, respectively, and located almost proximately to each other, a pair of upper and lower guide members 29*a* and 29*b* guiding the print sheet 22 transferred by the guide roller 27 and the timing roller 28 in a manner in which the guide members 29*a* and 29*b* put the print sheet 22 therebetween from both upper and lower directions, respectively, and a sheet clamp member 30 fixed to the tip end of the upper guide member 29*a*. The guide roller 27 is movable between a position at which the guide roller 27 press-contacts with the timing roller 28 and a separation position separated from the timing roller 28. Among the print sheets 22 moved according to the rotation of the scraper roller 24, only the uppermost print sheet 22 is permitted to be transferred by the pickup roller 25 and the stripper roller 26. The single print sheet 22 thus permitted to be transferred, is transferred further according to the rotation of the guide roller 27 and the timing roller 28 and synchronously with the rotation of the pressure drum 17. The constitution of a pair of upper and lower guide members 29*a* and 29*b* and that of the sheet clamp guide member 30 will be described later in detail.

(e) Sheet Discharge Section

The sheet discharge section 6 includes an upper restriction guide section 31 guiding the tip end of the print sheet 22 for which printing operation is completed, a sheet strip-off claw 32 stripping off the print sheet 22 which is not separated from the pressure drum 17, a sheet transfer mechanism 33 transferring the print sheet 22 guided by the upper restriction guide section 31 or stripped off by the sheet strip-off claw 32, and a stacker 34 mounting the print sheets 22 transferred by the sheet transfer mechanism 33 in a stacked state.

(f) Stencil Disposal Section

The stencil disposal section 7 includes a stencil disposal introduction belt 35 introducing the tip end of the stencil sheet 10 released from the stencil sheet clamp section 18 of the printing drum 16, a pair of stencil disposal and transfer belts 36 transferring the stencil sheet 10 introduced by the stencil disposal introduction belt 35 while stripping off the stencil sheet 10 from the printing drum 16, and a stencil disposal box 37 containing the stencil sheet 10 transferred by the paired stencil disposal and transfer belts 36.

(g) Constitution of Sheet Clamp Section, Sheet Clamp Guide Member and the Like

Figure 4A:
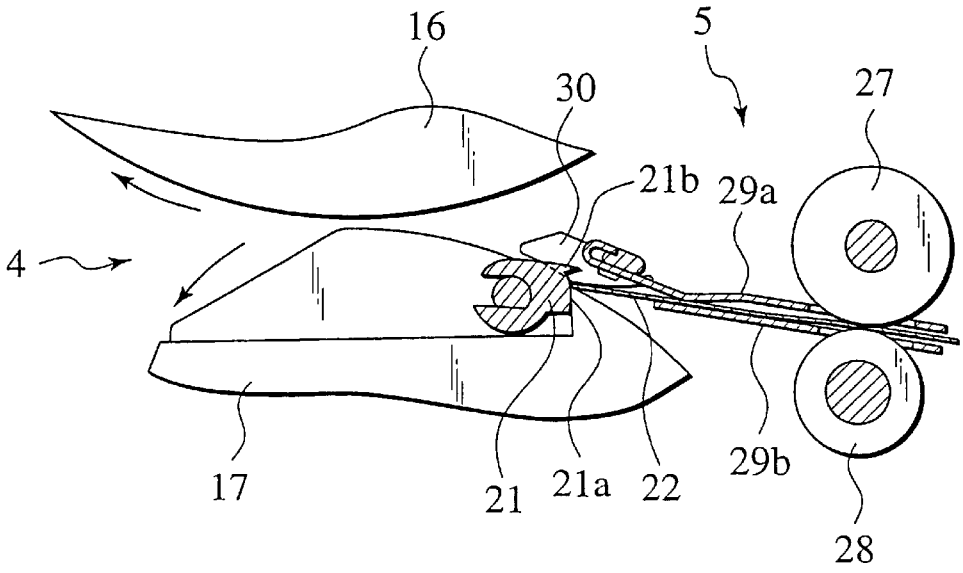
FIG. 4A is a side elevational view of the stencil printing machine in the first embodiment that shows a state in which the tip end of a print sheet, which is transferred from a paper feed section, abuts on a sheet clamp section.
Figure 4B:
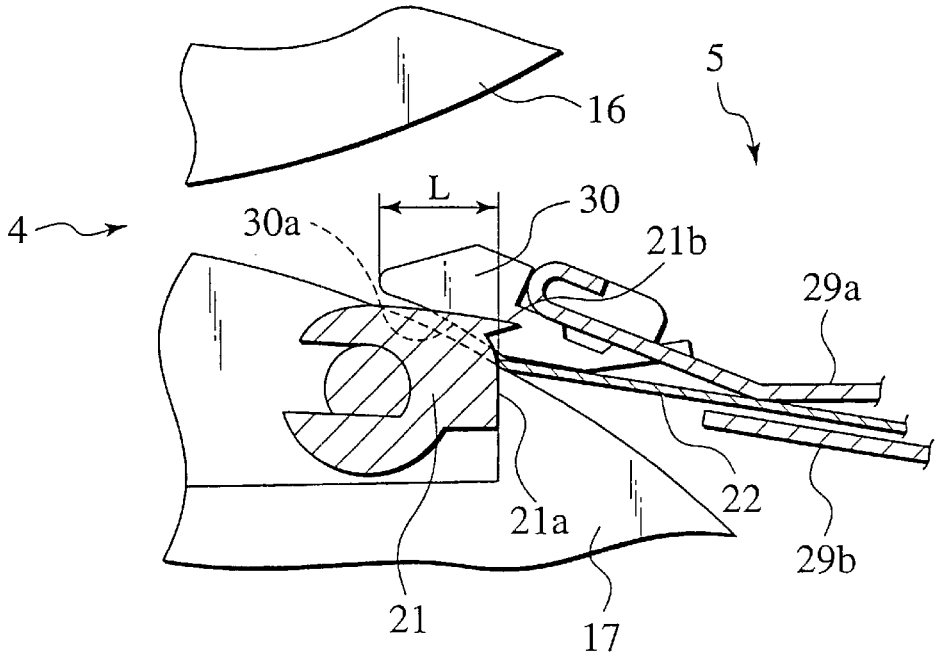
FIG. 4B is an enlarged side elevational view of the sheet clamp section shown in FIG. 4A;s
Figure 5:
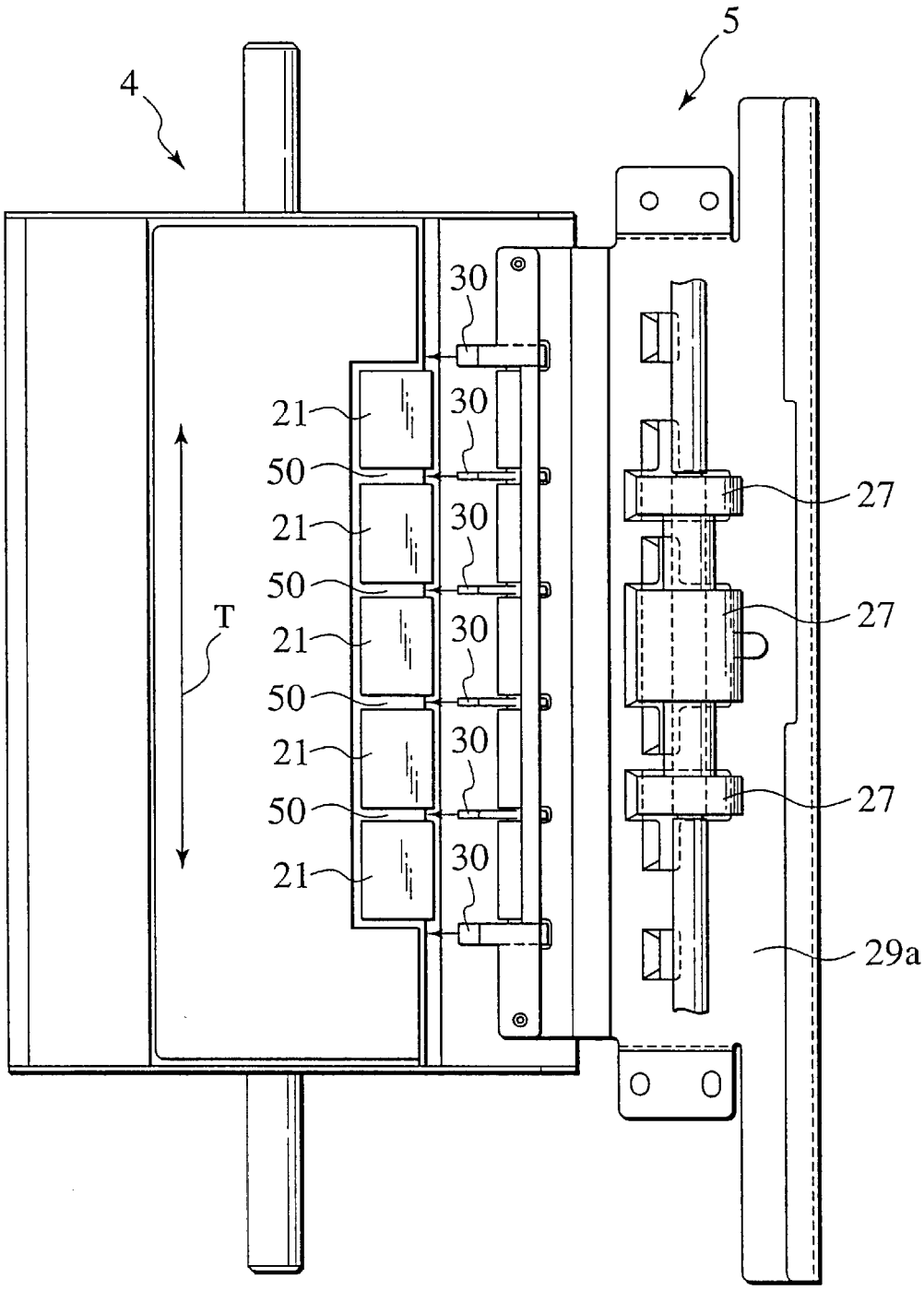
FIG. 5 is a plan view of a portion on which the print sheet is conveyed from the paper feed section to the sheet clamp section in the first embodiment according to the present invention.

The detailed constitution of the sheet clamp section 21 of the printing section 4, the guide members 29*a*, 29*b* and the sheet clamp guide member 30 of the paper feed section 5 will be described with reference to FIGS. 4A, 4B and 5. In FIGS. 4A, 4B and 5, the sheet clamp section 211 provided on the outer peripheral portion of the pressure drum, 17, is divided into a plurality of segments in a direction T substantially orthogonal to the sheet transfer direction. Guide entry spaces 50 (shown in FIG. 5) are provided between the adjacent divided segments, respectively. The sheet clamp section 21 includes a sheet abutment face 21*a* (shown in FIG. 4B in detail), and a sheet pressing protrusion 21*b* (shown in FIG. 4B in detail) located above the tip end of the print sheet 22 abutted on the sheet abutment face 21*a*.

Furthermore, the sheet clamp section 21 is rotatably provided between a clamp position at which the tip end of the print sheet 22 abutted on the sheet abutment face 21*a* is pressed from above and clamped, and an unclamp position at which the tip end of the print sheet 22 clamped is unclamped.

The tip end side of the pair of upper and lower guide members 29*a* and 29*b* is arranged on the lowest downstream portion of the paper feed section 5 in the sheet transfer direction. A space between the upper and lower guide members 29*a* and 29*b* is used as a sheet transfer path. The upper and lower guide members 29*a* and 29*b* are directed toward a predetermined rotation position upstream of the press portion on which the printing drum 16 and the pressure drum 17 press each other in a rotation direction. The sheet clamp guide member 30 is fixed to the tip end of the upper guide member 29*a*. That is, the sheet clamp guide member 30 is provided to extend from the upper guide member 29*a* arranged on the lowest transfer downstream portion of the paper feed section 5.

The sheet clamp guide member 30 guides the tip end of the print sheet 22, which is guided and transferred by the upper and lower guide members 29*a* and 29*b*, to a position (that is, a clamp spot) at which the tip end is abutted on the sheet abutment face 21*a* of the sheet clamp section 21. As shown in FIG. 4B in detail, the guide face 30*a* of the sheet clamp guide member 30, whose face is opposite to the outer peripheral surface of the pressure drum 17, is circular arc shaped. The sheet clamp guide member 30 is constituted to guide the tip end of the print sheet 22 to the transfer downstream position distant from the rotation position, at which the print sheet 22 is abutted on the sheet abutment face 21*a* of the sheet clamp section 21, by L. Moreover, the sheet clamp guide member 30 is divided into a plurality of segments in the direction T substantially orthogonal to the sheet transfer direction. The divided segments are arranged to enter the guide entry spaces 50 at the clamp position of the sheet clamp section 21, respectively. Accordingly, the sheet clamp guide member 30 is capable of guiding the print sheet 22 to the transfer downstream position distant from the rotation position, at which the print sheet 22 is abutted on the sheet abutment face 21*a* of the sheet clamp section 21, by L. Furthermore, the sheet clamp guide member 30 is capable of clamping the tip end of the print sheet 22 at a predetermined distance.

(2) Description of Operation

The operation of the printing machine 1 will be described.

In the stencil making section 3, the platen roller 13 and the stencil transport rollers 14 rotate to thereby transport the longitudinal stencil sheet 10. The respective dot-like heat elements of the thermal head 12 are selectively heated based on image information read by the original read section (not shown). The stencil sheet 10 is thermally perforated to make the perforated stencil sheet. The perforated stencil sheet 10 thus made is cut on the predetermined portion by an original cutter (not shown), thereby providing a perforated stencil sheet 10 having a predetermined length.

In the printing section 4, the tip end of the stencil sheet 10 thus made by the stencil making section 3, is clamped by the original clamp section 18 of the printing drum 16. The printing drum 16 is rotated in a state in which the tip end of the stencil sheet 10 is clamped and the stencil sheet 15 is wound around and attached onto the outer peripheral surface of the screen 19 of the printing drum 16. When printing is not carried out, the inner press roller 40 is put at the separation position to separate the inner press roller 40 from the screen 19. During printing, the inner press roller 40 is put at the press position and the printing drum 16 is rotated. Then, the inner press roller 40 is rotated on the inner peripheral surface of the screen 19 while pressing the inner peripheral side of the screen 19 except that the inner press roller 40 is located at an escape position around the stencil sheet clamp section 19. Since ink is continuously supplied to the outer peripheral surface of the inner press roller 40, the ink is transferred onto the screen 19 by the rotation of the inner press roller 40. The screen 19 is pressed by the inner press roller 40, thereby expanding the screen 19 toward the outer peripheral side and press-contacting the screen 19 with the pressure drum 17. Then, the print sheet 22 is transferred to the portion between the printing drum 16 and the pressure drum 17 from the paper feed section 5. The print sheet 22 thus transferred, is transferred further while being pressed by the screen 19 and the stencil sheet 15 between the inner press roller 40 and the pressure drum 17. In this press and transfer step, the ink is transferred onto the print sheet 22 from the pores of the stencil sheet 15 and an image is printed on the print sheet 22. When the tip end of the print sheet 22 passes the position of the inner press roller 40 and arrives at the downstream portion of the inner press roller 40, the sheet clamp section 21 unclamps the print sheet 22.

In the paper feed section 5, the print sheet 22 is transferred synchronously with the rotation of the printing drum 16 and the pressure drum 17. The tip end of the print sheet 22 is supplied from the press position, on which the printing drum 16 and the pressure drum 17 press each other, to the rotation clamp position upstream of the press position in the rotation direction.

In the sheet discharge section 6, the tip end side of the print sheet 22 is guided by the upper restriction guide section 31. The tip end side of the print sheet 22 is stripped off from the pressure drum 17 by the sheet strip-off claw 32. Thereafter, the print sheet 22 is transferred to the stacker 34 through the sheet transfer mechanism 33.

In the stencil disposal section 7, if the printing stencil sheet 10 is wound around and attached onto the outer peripheral surface of the screen 19 of the printing drum 16 at the time of starting a new stencil making operation, the stencil clamp section 18 of the printing drum 16 is released prior to the start of the new stencil making operation. The tip end side of the stencil sheet 10 unclamped from the stencil sheet clamp section 18, is introduced by the stencil disposal introduction belt 35 while the printing drum 16 is rotated. Then, the tip end side of the stencil sheet 10 is transferred by the paired stencil disposal and transfer belts 36, and contained in the stencil disposal box 37.

Figure 6:
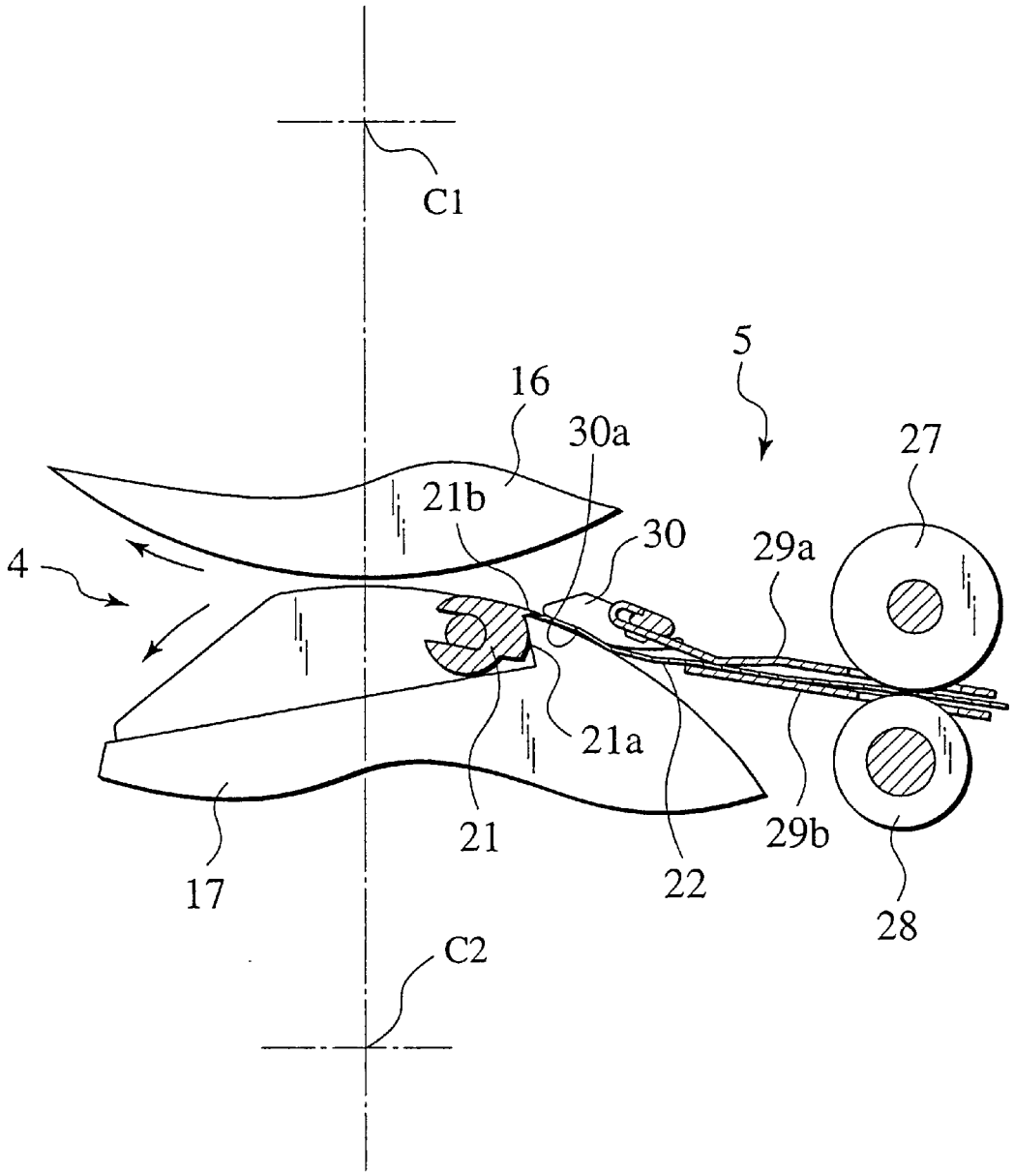
FIG. 6 is a side elevational view of the stencil printing machine in the first embodiment according to the present invention that shows a state in which the sheet clamp section clamps the tip end of the print sheet and in which a pressure drum slightly rotates from the clamp position.
Figure 7:
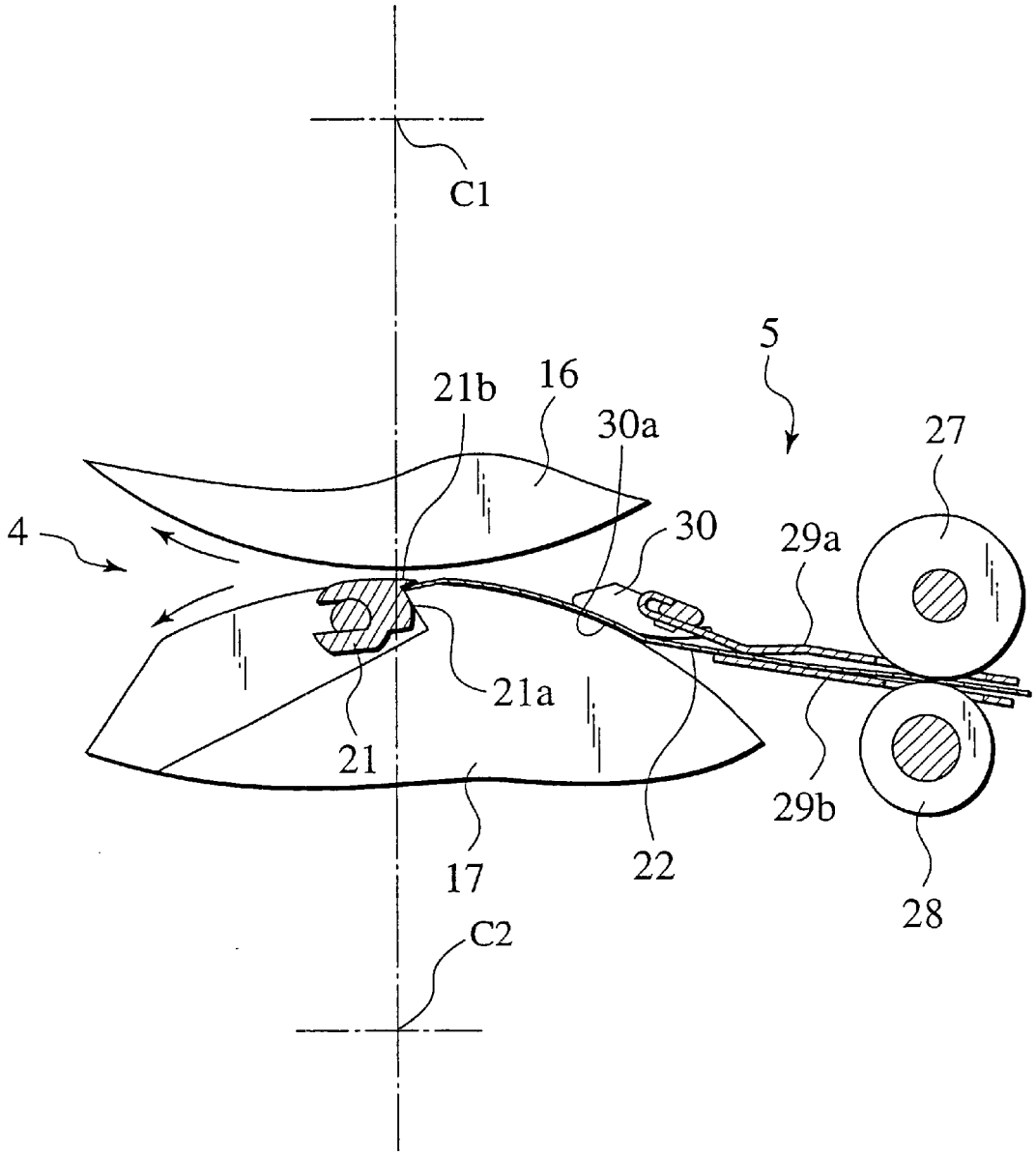
FIG. 7 is a side elevational view of the stencil printing machine in the first embodiment according to the present invention that shows a state in which the tip end of the print sheet is transferred to a press portion by the pressure drum.
Figure 8:
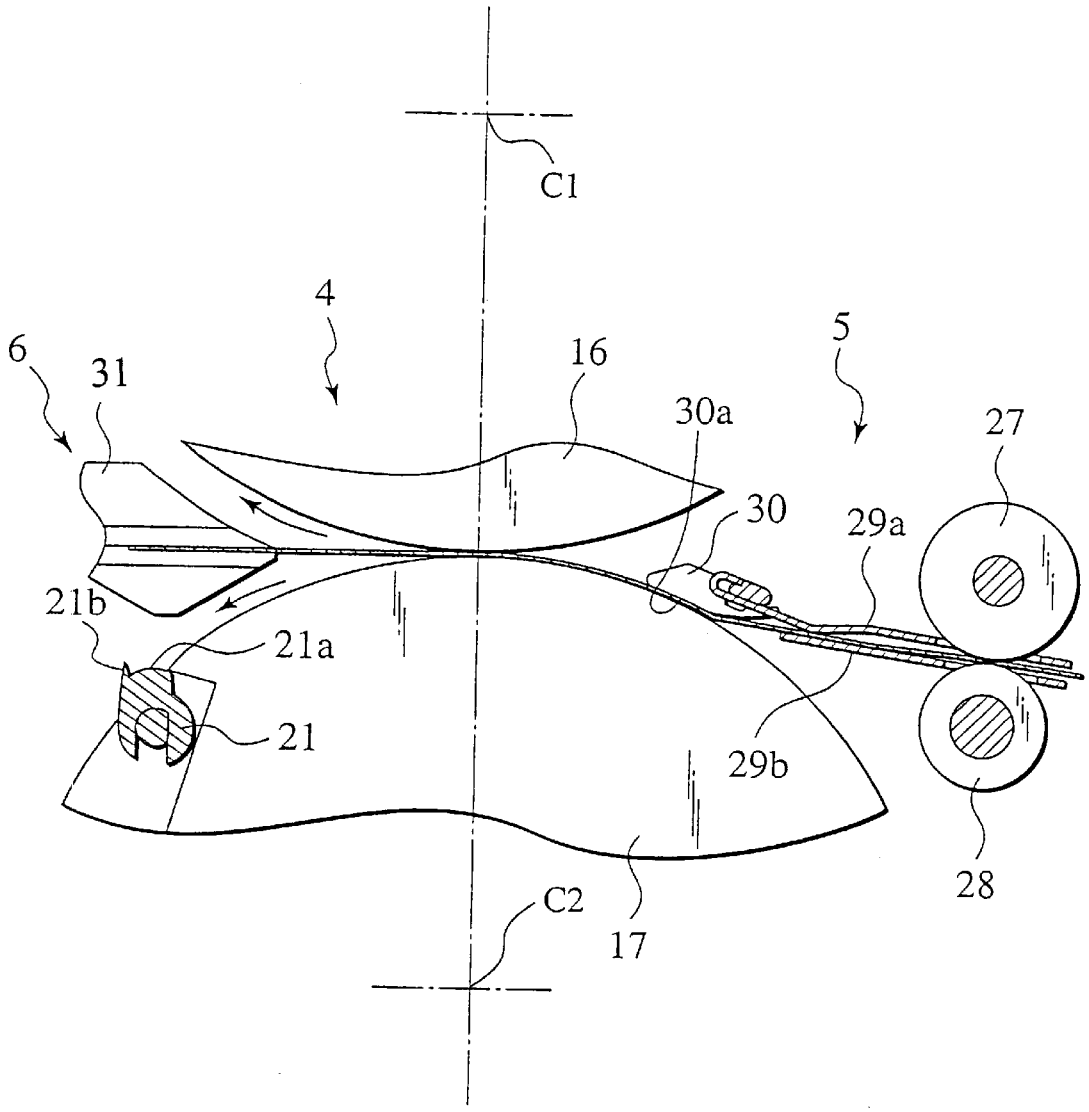
FIG. 8 is a side elevational view of the stencil printing machine in the first embodiment according to the present invention that shows a state in which the sheet clamp section unclamps the print sheet, and in which the unclamped tip end of the print sheet is guided to the sheet transfer mechanism of a sheet discharge section.

Next, an operation for clamping the tip end of the print sheet 22 transferred from the paper feed section 5 by the sheet clamp section 21 of the pressure drum 17 will be described in detail. The print sheet 22 is fed by both the guide roller 27 and the timing roller 28 so that the tip end of the print sheet 22 is abutted on the sheet abutment face 21*a* of the sheet clamp section 21 at timing at which the sheet clamp section 21 of the pressure drum 17 is located at the rotation position shown in FIGS. 4A and 4B. Then, as shown in FIG. 6, the sheet clamp section 21 rotates from the unclamp position to the clamp position, and clamps the tip end of the print sheet 22. As shown in FIG. 7, the print sheet 22 thus clamped is transferred along the outer peripheral surface of the pressure drum 17 synchronously with the rotation of the pressure drum 17. Thereafter, the print sheet 22 passes through the press portion on which the printing drum 16 and the pressure drum 17 press each other. Ink is transferred onto the print sheet 22 at the press position as described above. When the tip end of the print sheet 22 passes through the press portion on which the printing drum 16 and the pressure drum 17 press each other, the guide roller 27 is located at a position separated from the timing roller 28 and the transfer of the print sheet 22 is taken over by the rotation of the pressure drum 17. The sheet clamp section 21 unclamps the print sheet 22 downstream of the press portion on which the printing drum 16 and the pressure drum 17 press each other in the rotation direction, and the print sheet 22 thus unclamped is transferred to the sheet discharge section 6 as shown in FIG. 8.

In a series of the operations carried out in the paper feed section 5 and the printing section 4, even if the upward warp of the tip end side of the print sheet 22 or the like occurs or the print sheet 22 is made of a soft material, it is possible to ensure clamping the tip end of the print sheet 22 by the sheet clamp section 21 of the pressure drum 17. Therefore, the tip end side of the print sheet 22 is guided to the clamp spot of the sheet clamp section 21 located at the rotation clamp position by the sheet clamp guide member 30 taking over the guiding of the print sheet 22 conducted by the guide members 29*a* and 29*b*. Accordingly, the print sheet 22 is ensured being transported to the portion between the pressure drum 17 and the printing drum 16 without being clamped by the sheet clamp section 21, whereby it is possible to prevent sheet clogging caused by erroneous transfer operation, to prevent the tip end of the print sheet 22 from being flawed, the print sheet 22 from being bent or wrinkled.

The sheet clamp section 21 is divided into a plurality of segments in the direction T substantially orthogonal to the sheet transfer direction. Furthermore, the guide entry spaces 50 are formed between the adjacent divided segments, respectively. The sheet clamp guide member 30 is divided into a plurality of segments in the direction T almost orthogonal to the sheet transfer direction. The divided segments are arranged to enter the respective guide entry spaces 60 at the clamp position of the sheet clamp section 21. Accordingly, the sheet clamp guide member 30 guides the print sheet 22 on a plurality of portions in the direction T substantially orthogonal to the sheet transfer direction of the print sheet 22, thereby stably guiding the print sheet 22 by the sheet clamp guide member 30 and ensuring clamping the tip end of the print sheet 22. Furthermore, since the guide face 30a of the sheet clamp guide member 30 can be made sufficiently close to the outer peripheral surface of the pressure drum 17, it is possible to guide the print sheet 22 more stably.

Since the sheet clamp guide member 30 is arranged so that the guide face 30*a* opposite to the pressure drum 17 has a predetermined length L along the outer peripheral surface of the pressure drum 17, the angle of the sheet clamp guide member 30 at which the member 30 embracing the pressure drum 17, becomes wider. As a result, the stable transfer of the print sheet 22 by the pressure drum 17 is ensured.

Since the sheet clamp guide member 30 is extended from the guide member 29*a* arranged on the lowest transport downstream portion of the paper feed section 5, it is possible to ensure guiding the print sheet 22 from the guide member 29*a* of the paper feed section 5. Moreover, the guide members 29*a* and 29*b* are arranged to be positioned with respect to the pressure drum 17, thereby facilitating the positioning of the sheet clamp member 30 with respect to the sheet clamp section 21.

2. Second Embodiment

Figure 9:
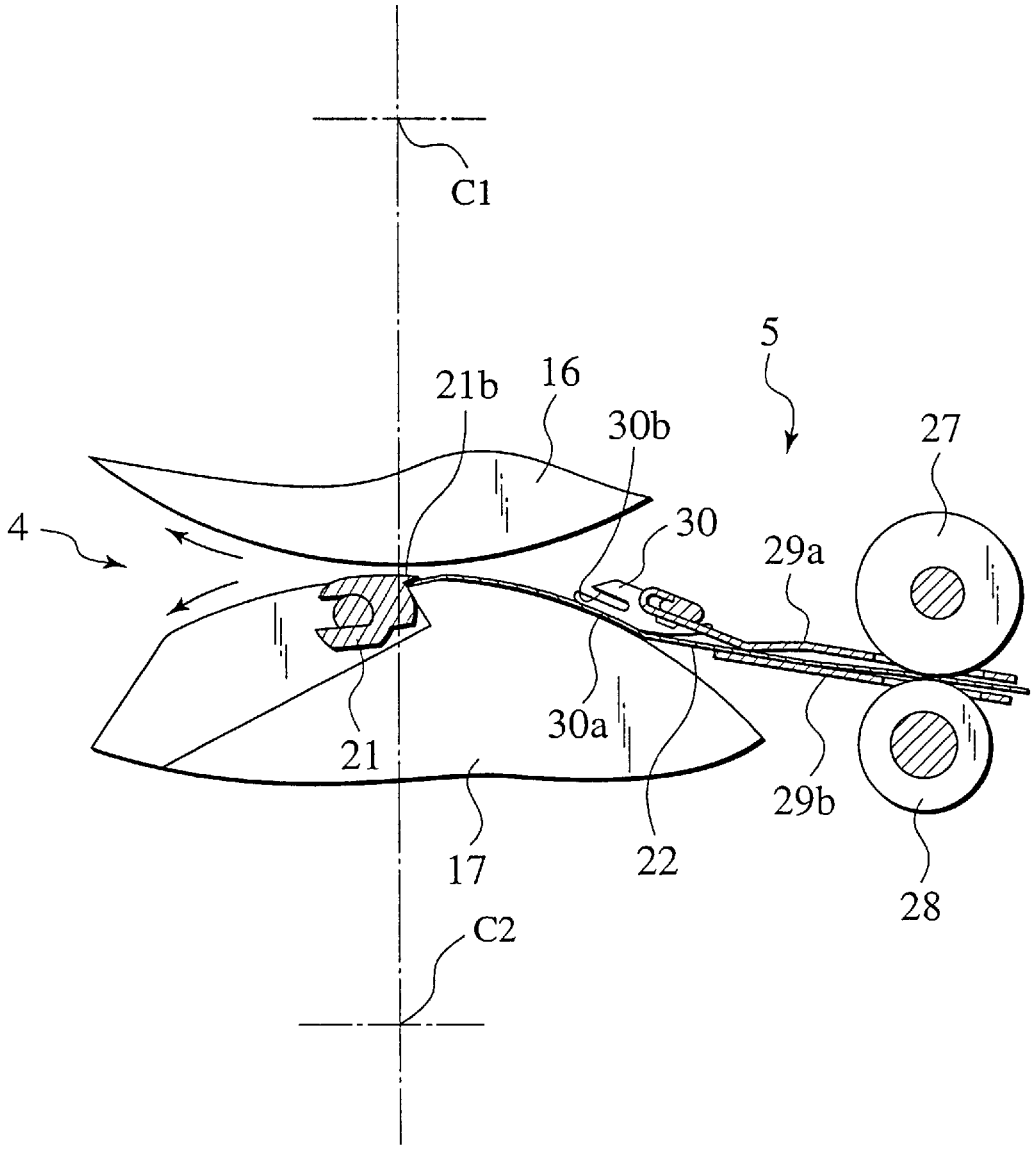
FIG. 9 is a side elevational view of the stencil printing machine in the second embodiment according to the present invention that shows a state in which a sheet clamp section clamps the tip end of a print sheet, and in which the tip end of the print sheet is transferred from a clamp position to a press portion by a pressure drum.

FIG. 9 shows the second embodiment of the present invention. The second embodiment differs from the first embodiment (see FIG. 7) only in the constitution of the sheet clamp guide member 30. A sheet clamp guide member 30 in the second embodiment is provided with a notch section 30*b* so that the sheet clamp member 30 can be easily bent in a direction opposite to a direction in which the print sheet 22 contacts with the member 30 when the print sheet 22 contacts with the member 30. Since the remaining constitution is the same as that of the first embodiment, no description will be given to the remaining constitution to avoid repetitive description and the same constituent elements as those in the first embodiment are denoted by the same reference symbols for the sake of clarification.

The second embodiment has the same function and advantage as those of the first embodiment. Namely, a sheet clamp section 21 clamps the tip end of a print sheet 22. If the print sheet 22 thus clamped is transferred along the outer peripheral surface of a pressure drum 17 according to the rotation of the pressure drum 17 and the print sheet 22 contacts with: the sheet clamp guide member 30, the sheet clamp guide member 30 is easily bent in the opposite direction to the contact direction, so that transfer noise generated when the pressure drum 17 transfers the print sheet 22, is reduced. Moreover, the pressure acting on the print sheet 22 is reduced, as well, thereby making it possible to reduce transfer resistance. The constitution that the sheet clamp guide member 30 is easily bent, is realized by forming the member 30 to have a bendable shape. Alternatively, this constitution may be realized by forming the sheet clamp guide member 30 by a bendable material.

As a modification of the embodiment of the present invention, the upper guide member 29*a* which is arranged on the lowest transport downstream portion of the paper deed section 5, may be constituted to be easily bent in the opposite direction to the contact direction when the print sheet 22 contacts with the upper guide member 29*a*. By thus constituting the upper guide member 29*a*, if the sheet clamp section 21 clamps the tip end of the print sheet 22, the print sheet 22 thus clamped is transferred along the outer peripheral surface of the pressure drum 17 according to the rotation of the pressure drum 17, the print sheet 22 contacts with the guide member 29*a* and the guide member 29*a* is easily bent in the opposite direction to the contact direction. Accordingly, transfer noise generated when the pressure drum 17 transfers the print sheet 22, is reduced. Furthermore, pressure acting on the print sheet 22 is reduced, as well, thereby making it possible to reduce transfer resistance. The constitution that the upper guide member 29*a* is easily bent, may be realized by forming the guide member 29*a* by a bendable material. If both the sheet clamp guide member 30 and the upper guide member 29*a* are constituted to be easily bendable, it is possible to reduce transfer noise and transfer resistance more effectively.

In the above described each embodiment, the sheet clamp guide member 30 is fixed to the upper guide member 29*a* of the paper feed section 5. The sheet clamp guide member 30 may be fixed to a member other than the upper guide member 29*a*. In addition, to drive the guide roller 27 and the timing roller 28 for transferring the print sheet 22 toward the pressure drum 17 at predetermined timing, arbitrary driving means (a sector gear type, a pulse motor type or the like) may be employed.

What is claimed is:

1. A printing machine comprising:

a printing drum around which a perforated stencil sheet is wound, and which is provided rotatably about a first axis;

a pressure drum having a sheet clamp section for clamping a tip end of a print sheet, and which is provided rotatably about a second axis, outer peripheral surfaces of the printing drum and the pressure drum provided to be freely pressed relatively to each other, the printing drum and the pressure drum opposite to each other on their respective outer peripheral surfaces;

a pair of substantially planar guide members defining a sheet transfer path therebetween disposed on an upstream side of a rotation clamp position; and a sheet clamp guide member carried by a downstream end of one of said guide members for guiding a tip end of a print sheet which is transferred from a paper feed section to a clamp spot of a sheet clamp section located at the rotation clamp position;

wherein the tip end of the print sheet, which is transferred from the paper feed section synchronously with rotation of both the printing drum and the pressure drum, is clamped by the sheet clamp section at the rotation clamp position upstream of a press position in a rotation direction, the printing drum and the pressure drum press each other on the press position, the print sheet thus clamped is transferred along the outer peripheral surface of the pressure drum and the print sheet is pressed against the perforated stencil sheet on the press position, whereby printing is conducted to the print sheet.

2. A printing machine according to claim 1, wherein the sheet clamp section is divided into a plurality of segments in a direction substantially orthogonal to a sheet transfer direction;

wherein guide entry spaces are provided between the divided segments of the sheet clamp section adjacent each other, respectively;

and wherein the sheet clamp guide member is divided into a plurality of segments in the direction substantially orthogonal to the sheet transfer direction, and the divided segments of the sheet clamp guide member are arranged to enter the guide entry spaces, respectively, at the clamp position of the sheet clamp section.

3. A printing machine according to claim 1, wherein a guide face, opposite to the pressure drum, of the sheet clamp guide member is arranged along the outer peripheral surface of the pressure drum with a predetermined distance from the pressure drum.

4. A printing machine according to claim 1, wherein the sheet clamp guide member further comprises a resilient portion bendably connected to another portion thereof, said resilient portion being bendable in a direction opposite to a contact direction when the print sheet contacts said resilient portion of said sheet clamp guide member.

5. A printing machine according to claim 1, wherein each of the guide members further comprises a resilient portion bendably connected to another portion thereof, said resilient portion being bendable in a direction opposite to a contact direction when the print sheet contacts said resilient portion of each of the guide members.

6. A printing machine comprising:

a printing drum around which a perforated stencil sheet is wound, and which is provided rotatably about a first axis;

a pressure drum having a sheet clamp section for clamping a tip end of a print sheet, and which is provided rotatably about a second axis, outer peripheral surfaces of the printing drum and the pressure drum provided to be freely pressed relatively to each other, the printing drum and the pressure drum opposite to each other on their outer peripheral surfaces, wherein the tip end of the print sheet, which is transferred from a paper feed section synchronously with rotation of both the printing drum and the pressure drum, is clamped by the sheet clamp section at a rotation clamp position upstream of a press position in a rotation direction, the printing drum and the pressure drum press each other on the press position, the print sheet thus clamped is transferred along the outer peripheral surface of the pressure drum and the print sheet is pressed against the perforated stencil sheet on the press position, whereby printing is conducted to the print sheet; and wherein the printing machine is provided with a sheet clamp guide member for guiding the tip end of the print sheet, which is transferred from the paper feed section, to a clamp spot of the sheet clamp section located at the rotation clamp position; and wherein the sheet clamp section is divided into a plurality of segments in a direction substantially orthogonal to a sheet transfer direction; wherein guide entry spaces are provided between the divided segments of the sheet clamp section adjacent each other, respectively; and wherein the sheet clamp guide member is divided into a plurality of segments in the direction substantially orthogonal to the sheet transfer direction, and the divided segments of the sheet clamp guide member are arranged to enter the guide entry spaces, respectively, at the clamp position of the sheet clamp section.

7. A printing machine according to claim 6, wherein a guide face, opposite to the pressure drum, of the sheet clamp guide member is arranged along the outer peripheral surface of the pressure drum with a predetermined distance from the pressure drum.

8. A printing machine according to claim 6, wherein the sheet clamp guide member further comprises a resilient portion bendably connected to another portion thereof, said resilient portion being bendable in a direction opposite to a contact direction when the print sheet contacts said resilient portion of said sheet clamp guide member.

9. A printing machine according to claim 6, wherein the paper feed section comprises: guide members, wherein the sheet clamp guide member is arranged on a lowest transfer downstream portion of the paper feed section, and extended from one of the guide members for guiding the print sheet by putting the print sheet between the guide members from both upper and lower directions.

10. A printing machine according to claim 9, wherein each of the guide members further comprises a resilient portion bendably connected to another portion thereof, said resilient portion being bendable in a direction opposite to a contact direction when the print sheet contacts said resilient portion of each of the guide members.

* * * * *